US007090541B1

(12) United States Patent
Ho

(10) Patent No.: US 7,090,541 B1
(45) Date of Patent: Aug. 15, 2006

(54) SLIM USB ELECTRONIC DEVICE

(75) Inventor: Hsin-Chiang Ho, Taipei (TW)

(73) Assignees: Inventec Multimedia & Telecom Corporation, Taipei (TW); Sony Corporation, Tokyo (JP)

( * ) Notice: Subject to any disclaimer, the term of this patent is extended or adjusted under 35 U.S.C. 154(b) by 0 days.

(21) Appl. No.: 11/138,381

(22) Filed: May 27, 2005

(51) Int. Cl.
*H01R 24/00* (2006.01)

(52) U.S. Cl. ..... 439/660; 439/76.1
(58) Field of Classification Search ..... 439/660, 439/76.1, 680
See application file for complete search history.

(56) References Cited

U.S. PATENT DOCUMENTS

| | | | | |
|---|---|---|---|---|
| 5,899,773 | A * | 5/1999 | Cheng | 439/680 |
| 5,993,263 | A * | 11/1999 | Sampson | 439/660 |
| 6,109,939 | A * | 8/2000 | Kondo et al. | 439/680 |
| 6,877,994 | B1 * | 4/2005 | Huang | 439/76.1 |
| 2005/0085133 | A1 * | 4/2005 | Wang et al. | 439/660 |

* cited by examiner

*Primary Examiner*—Tho D. Ta

(57) ABSTRACT

A slim USB electronic device, which includes a substrate and a housing enclosing the substrate, is disclosed. The substrate includes a circuit board and an extended connector. Electrically conductive metal strips are adhered to the connector, and integrated circuit elements are mounted on the substrate. The housing has openings, through which the corresponding metal strips are exposed and electrically communicate with the contacts of an USB receptacle.

10 Claims, 4 Drawing Sheets

SLIM USB ELECTRONIC DEVICE

BACKGROUND OF THE INVENTION

1. Field of the Invention

The invention discloses a USB electronic device and specially relates to a slim USB electronic device.

2. Description of the Prior Art

With the progress in the information technology (IT) industry, portable electronic devices become more and more popular. Some of them, such as a flash drive or a small memory card, are capable of communicating with host (PC or notebook computer) through specific transmission interfaces, in which the universal serial bus (USB) is the most popular one. Because the USB is one of the most popular I/O interfaces in current personal computers, many electronic devices adopt USB as their transmission interface. The advantage of utilizing the USB is that it reduces the usage of a card reader for portable devices with different I/O interface.

Conventionally the connector for the USB electronic device is separated from the circuit board, and fabricated together by a weld. Because the USB connector's limitations, however, the USB electronic device will become too thick to be portable. Referring to FIG. 1, the housing 100 of the USB connector will influence and increase the volume and thickness of the electronic device. In order to reducing the thickness of all electronic elements among the electronic device as possible, the most regular solution is to improve the USB connector's structure, or to apply a design without connector for thinning out the electronic device. Referring to FIG. 2A and FIG. 2B, Taiwan patent number 570242 discloses a USB storage device, therein the connector 202 is extended from the circuit board and enclosed in an upper housing 200 and a lower housing 201. By utilizing the contacts of a USB receptacle to touch the metal film 204 electroplated directly on the connector 202, the USB storage device could establish an electric loop with the host. However, as the connector 202 inserts and pulls out over and over again, the metal film 204 becomes easier to peel off, resulting in the USB storage device being unable to be used. Besides, most areas of the connector 202 are exposed from the device housing, making the contacts (formed of metal films) short circuit easier by external matter which decrease the electronic device's life.

FIG. 3 illustrates the simplified structure of a small USB connector disclosed in Taiwan patent number 565026, therein connector 30 and circuit board 31 are manufactured whole in one and placed in the lower housing 38. The upper housing 37 merely covers parts of the connector 30 and forms the device's housing with the lower housing 38. In addition, four metal strips 33 are adhered on the connector 30 as the contacts for communicating with an USB receptacle (not shown). Although this structure overcomes the problem that the metal film peels off easily, the connector 30 is still exposed to too external matter. Further, because it's necessary to drill on the connector 30 before adhering the metal strips 33, and a metal housing 39 shaped of U letter is also needed for protecting the connector 30, the structure of the USB electronic device becomes more complicated and harder to fabricate, resulting in difficulties in reducing production costs.

According to the above descriptions, the foregoing two inventions may achieve the goal for a slim USB electronic device, but there are still some disadvantages to overcome. Therefore, there is need to further reduce the thickness of the USB connector and the thickness of the USB electronic device, to overcome the foregoing disadvantages, and provide more protection for the connector (especially contacts of USB electronic device).

SUMMARY OF THE INVENTION

As the shortcomings of conventional USB devices are discussed in the prior art, an objective of the invention is to provide a USB electronic device which having a slim structure.

A another objective of the invention is to provide an improved USB electronic device, in which the substrate and other electronic elements are substantially enclosed for preventing the connector and the contacts of the USB electronic device to become unnecessarily revealed, thereby gaining more protection.

A further objective of the invention is to provide an improved USB electronic device, in which every opening corresponds to a metal strip to make the improved USB electronic device functional for guiding each contact of an USB receptacle into the right position, and prevent mutual influences between the two metal strips or short circuit caused by external matter.

In accordance to the foregoing objectives of the invention a USB electronic device is disclosed, which comprises a substrate having a circuit board and a connector extending from the circuit board. Some metal strips adhere onto the connector, which is then electrically connected to the circuit board. At least one integrated circuit is mounted on the substrate, and a housing has openings, through which the corresponding metal strips are exposed and are electrically communicable with the contacts of a USB receptacle.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description and the accompanying drawings, which are given by way of illustration only, and thus are not limitative of the present invention, and in which.

DESCRIPTION OF THE PREFERRED EMBODIMENT

The preferred embodiment of the present invention is now described in great detail. Nevertheless, it should be recognized that the present invention can be practiced in a wide range of embodiments besides those explicitly described, and the scope of the present invention is expressly not limited except as specified in the accompanying claims.

Figure 1:
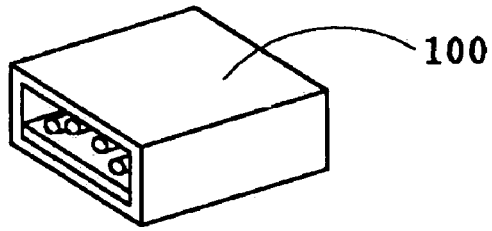
FIG.1(Prior Art)
FIG. 1A illustrates a conventional USB connector.
Figure 2A:
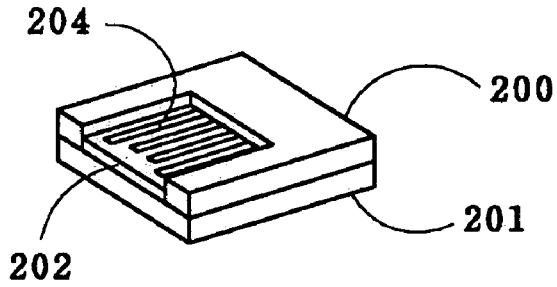
FIG.2A(Prior Art)
FIG. 2A and FIG. 2B respectively illustrates a USB connector's structure of the prior art and its explosion drawing.
Figure 2B:
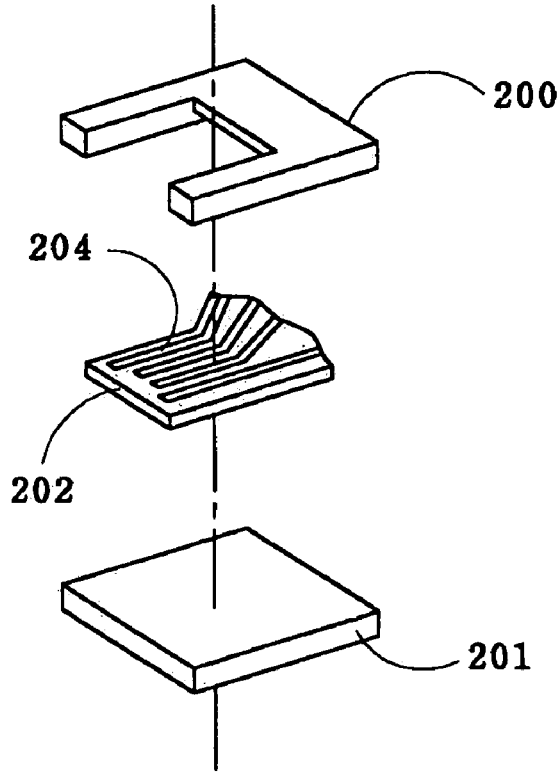
FIG.2B(Prior Art)
Figure 3:
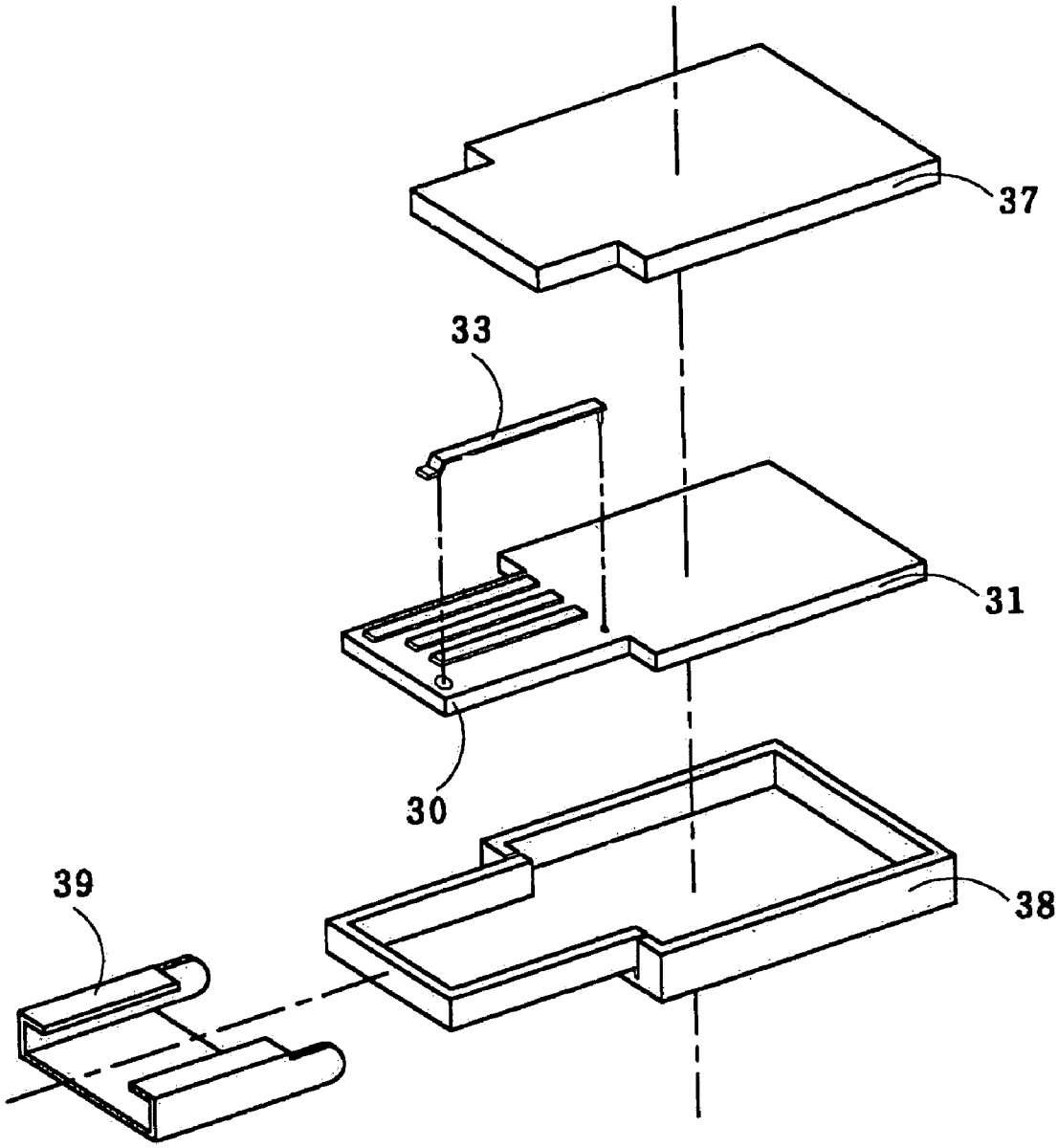
FIG.3(Prior Art)
FIG. 3 illustrates the explosion drawing of a USB connector of another prior art.
Figure 4A:
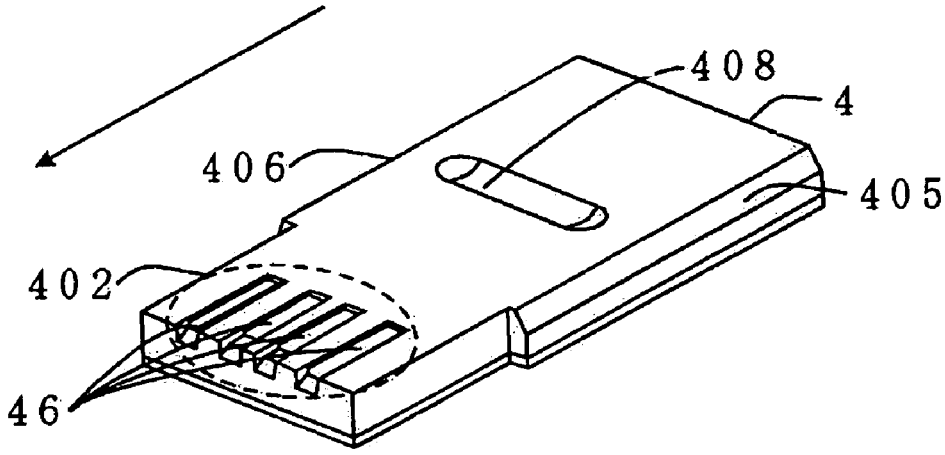
FIG. 4A is the preferred embodiment of the invention.

FIG. 4A illustrates a slim USB electronic device, which is the preferred embodiment of the invention and specially an USB storage device. The arrow indicates the direction of the USB electronic device while inserting into an USB receptacle. The disclosed USB electronic device is enclosed with a housing 4, which opens some openings 402 (four in this embodiment) for exposing inner metal strips 46 as the contact for communicating with the USB receptacle of a host.

Figure 4B:
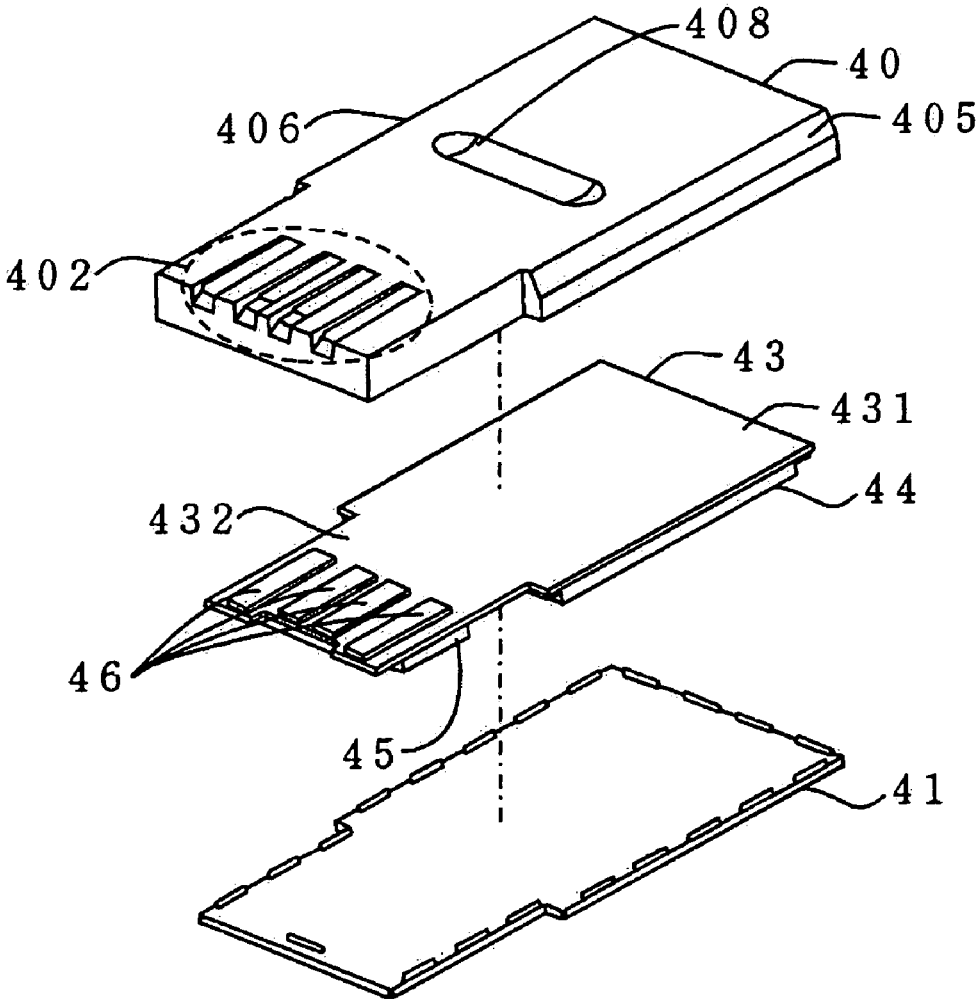
FIG. 4B is the explosion drawing of the preferred embodiment of the invention.

FIG. 4B is the explosion drawing of the preferred embodiment of the invention illustrating in FIG. 4A. Referring to FIG. 4B, the inner structure is distinctly revealed, therein every composing element of the USB electronic device are substantially enclosed in the upper housing 40 and lower housing 41. The composing elements include a substrate 43,; which further comprises a circuit board 431 having an essential circuit layout, and a connector 432 extending from the circuit board 431. The preferred material of substrate 43 in this embodiment is a printed circuit board (PCB).

Metal strips 46, such as bronze strips, are adhered to a connector 432, and electrically connecting to the layout of circuit board 431. Means for fixing metal strip 46 on connector 432 are not limited, in which surface-mount technology (SMT) is preferred and applied in the embodiment. By reference to SMT, metal strips 46 directly adhere on connector 432 as the contacts for communicating with USB receptacle, advantaging of avoiding drilling on connector 432 which simplifies manufacture and reducing the costs.

A memory 44, such as a FLASH RAM, is mounted beneath substrate 43 for storing data. Besides, the bottom of substrate 43 further comprises a USB controller 45 for transforming an incoming USB signal into data and storing in the memory 44, or transforming the data stored in memory 44 into a USB signal to communicate with the host through metal strips 46.

It is noted that other elements except memory 44 and USB controller 45 could be mounted on the substrate 43. Furthermore, the memory 44 and USB controller 45 could be replaced by other type of integrated circuit. In other words, applications of the invention are not limited as a storage device, but applicable to the electronic devices of other purpose.

Figure 4C:
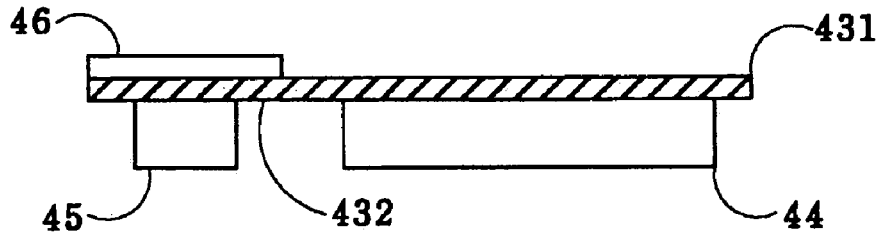
FIG. 4C is the side view for substrate of the preferred embodiment.

In order to achieve the goal for a slim USB electronic device, memory 44, USB controller 45, and metal strips 46 are designed as thin as possible. Besides, putting memory 44, USB controller 45, or other elements on the same side of substrate 43 (bottom in this embodiment) avoids increasing the thickness compared to putting them on both sides of the substrate 43. Hence, referring to FIG. 4C, in which memory 44 is mounted beneath the circuit board 431 and the USB controller 45 is mounted beneath the connector 432 for optimizing the usage of space.

In the preferred embodiment of the invention, openings 402 sets on the upper housing 40 are counted in four and strip-shaped, and certainly the width of each opening and the interval between two adjacent openings should be compatible with the USB standard. Through openings 402 only metal strips 46 are exposed from the upper housing 40. In other words, each metal strip corresponds to an opening and partially exposed part of the upper housing 40 as contacts for electrically communicating with the USB receptacle. Because the height of the metal strips 46 is lower than the surface of the upper housing 40, hence the thickness of the invention won't be increased, and a flatter structure for USB electronic devices will be achieved. In addition, the upper housing 40 near the front end of each openings 402 further forms a inclined plane which has the advantage of making the contacts of the USB receptacle more smooth to touch the metal strips 46.

Comparing to the prior arts, the major difference is that there are a plurality of openings opened on the device housing to merely expose the metal strips excluding the other areas of the connector. The particular structure design for the device housing benefits in many ways. First, because every exposed metal strip is separated from each other by the upper housing 40, it's more difficult to bring about short circuits between the two metal strips cause by external matter. Second, except for parts of metal strips 46, the other areas of the connector 432 are totally enclosed in the housing 4, hence it makes less of an exposed area of the connector of the invention than that of the prior art. Besides, the height of metal strips 46 are lower than the surface of the upper housing 40, therefore the USB connector is harder to be stressed by foreign matter and thus obtains more protection. Furthermore the upper housing 40 isolates each metal strip with a relative higher surface, guiding the contacts of the USB receptacle to the corresponding metal strip, which prevents more than one contacts of the USB receptacle erroneously touching the same metal strip.

Figure 4D:
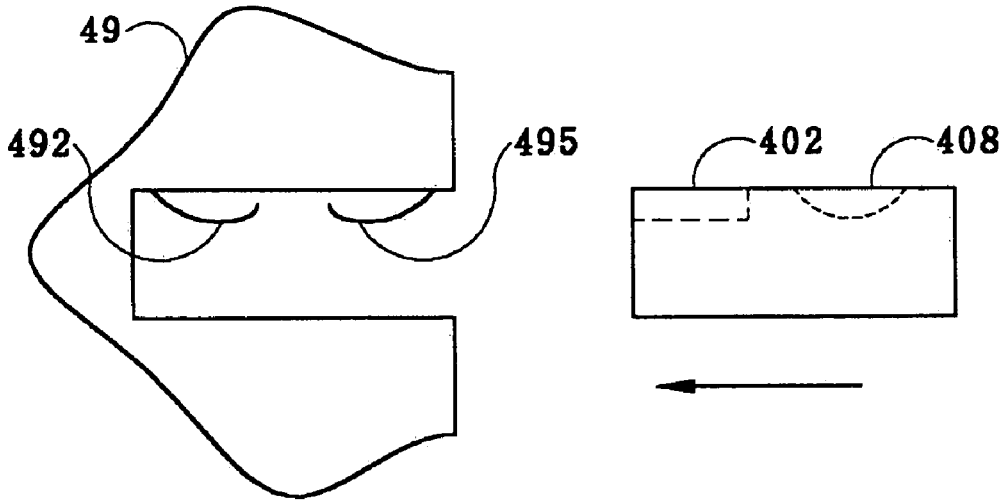
FIG. 4D shows the side view of the preferred embodiment of the invention and an USB receptacle.

In addition, housing 4 may make some variations to the design to achieve more functions, for example, the upper housing 40 may further form a hole 408. FIG. 4D shows the side view of the invention and the USB receptacle, in which the preferred embodiment of the invention is inserting into the USB receptacle from right to left. For USB receptacle 49 having a larger depth and inner volume, it's feasible to add a bolt 495 to lodge in hole 408. As the preferred embodiment of the invention inserting into USB receptacle 49, bolt 495 and contacts 492 slightly lift till the disclosed USB electronic device is in the right position. Among them through openings 402 contacts 492 touch the metal strips, and bolt 495 inserts in the hole 408 to fasten the electronic device, which achieves more robust connection with the USB receptacle 49.

Figure 4E:
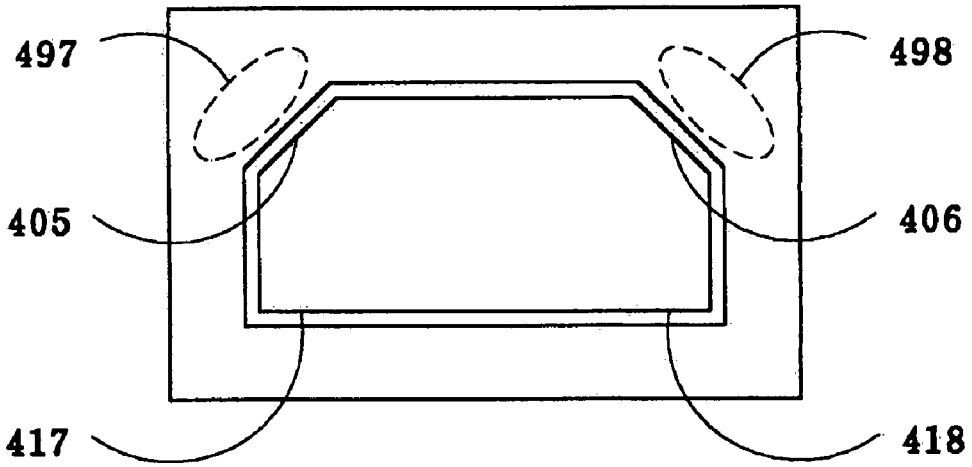
FIG. 4E shows the front view of the preferred embodiment of the invention and an USB receptacle.

Furthermore, flanks of housing 4 may form incline 405, 406 as shown in FIG. 4A, thereby resulting in asymmetry of the disclosed electronic device. For a USB receptacle shaped as shown in FIG. 4E, if the electronic device is overturned, the triangular corner 497, 498 will block the bottom sides of electronic device (417,418). It means the incline 405, 406 provides a foolproof mechanism that insures reverse insertion is denied. It's stressed that, the incline 405,406 is not only limited to form on the top flanks of the housing 4, but also the bottom, top and bottom of one flank, or only one incline 405 is permitted. With a compatible USB receptacle, the USB electronic device of the invention achieves a foolproof function. Besides, hole 408 and the incline 405, 406 are optional, the designer for the electronic device may decide by himself if applying the foregoing design is needed or not.

For the above descriptions, the disclosed invention achieves several advantages such as: achieving the major goal of the invention for a slim USB electronic device; the particular design for openings through which merely exposes the essential metal strips results in providing the connector and adhered contacts more protection than the prior art; and furthermore, it may optionally design a hole over the housing for fastening the USB electronic device, or forms at least one incline as a foolproof mechanism. Hence obviously the disclosed USB electronic device of the invention is superior to the prior art, and the invention is novel and progressive.

The above-mentioned are only the preferred embodiments of the present invention, not intended to limit the scope thereof. It will be appreciated and carried out by those professions skilled in the art. Thus, many modifications of the embodiments that can be made without departing from the spirit of the present invention should be covered by the following claims.

What is claimed is:

1. A USB electronic device being insertable into a USB receptacle, comprising:

a substrate having a circuit board and a connector extending from the circuit board;

a plurality of metal strips adhering to the connector, ends of the metal strips being electrically connected to the circuit board;

at least one integrated circuit mounted on the substrate; and a housing, the housing having:

a plurality of openings, through which the corresponding metal strips are exposed and are electrically communicable with contacts of the USB receptacle;

a hole arranged on a top surface of the housing; and at least one incline formed on a top or bottom surface of both flanks of a main section of the housing, rather than a connector section of the housing.

2. The USB electronic device of claim 1, wherein the at least one integrated circuit is mounted on a same surface of the substrate, thereby reducing a thickness of the USB electronic device.

3. The USB electronic device of claim 1, wherein the substrate is substantially enclosed in the housing.

4. The USB electronic device of claim 1, wherein a width of each opening and an interval between adjacent openings are compatible with a USB standard.

5. The USB electronic device of claim 1, wherein the metal strips are mounted onto the substrate by surface mounting technology (SMT).

6. The USB electronic device of claim 1, wherein the at least one integrated circuit comprises a memory for storing data.

7. The USB electronic device of claim 6, wherein the at least one integrated circuit further comprises a USB controller for transforming the data of the memory into a USB signal compatible with a USB standard, or reversely transforming an incoming USB signal and then storing the transformed USB signal into the memory.

8. The USB electronic device of claim 7, wherein the USB controller establishes an electric loop with the memory.

9. The USB electronic device of claim 1, wherein the openings are arranged on a top surface of the housing and are extended forward to a front end of the housing.

10. The USB electronic device of claim 9, further comprising an inclined plane along the openings at the front end of the housing.

* * * * *